United States Patent [19]

Eide et al.

[11] Patent Number: 5,009,349

[45] Date of Patent: Apr. 23, 1991

[54] LIFTING AND CARRYING DEVICE

[76] Inventors: Geir O. Eide, Olav Bismos gate 9, N-2670 Otta; Dag I. Eide, Maelan 12, N-7460 Røros, both of Norway

[21] Appl. No.: 376,853

[22] Filed: Jul. 6, 1989

[30] Foreign Application Priority Data

Jul. 8, 1988 [NO] Norway ..... 883058

[51] Int. Cl.[5] ..... A45F 3/04

[52] U.S. Cl. ..... 224/260; 224/264

[58] Field of Search ..... 224/260, 259, 265, 266, 224/264, 267, 262, 263, 209

[56] References Cited

U.S. PATENT DOCUMENTS

| | | | |
|---|---|---|---|
| 910,238 | 1/1909 | Shaw | 224/268 |
| 1,340,076 | 5/1920 | Orr . | |
| 1,542,163 | 12/1923 | Morde | 224/209 |
| 1,879,480 | 9/1932 | Pures | 224/260 |
| 2,477,432 | 7/1949 | Walsh | 224/260 |
| 2,563,766 | 8/1951 | Weinstein et al. | 119/96 |
| 2,677,488 | 5/1954 | Prusan | 119/96 |
| 2,718,988 | 9/1955 | Potts . | |
| 4,280,645 | 7/1981 | Goodden | 224/259 |
| 4,327,852 | 5/1982 | Gibson . | |

FOREIGN PATENT DOCUMENTS

| | | | |
|---|---|---|---|
| 190880 | 1/1923 | United Kingdom | 224/260 |

*Primary Examiner*—Linda J. Sholl

*Attorney, Agent, or Firm*—Jackson & Walker

[57] ABSTRACT

A lifting and carrying device is adapted for support on a user's body and permits the user to lift and carry articles of various size, shape and weight. An elongated and relatively soft shoulder and neck yoke carries a tie loop in the area of each end portion of the neck yoke and depends therefrom. A support extends between the tie loops, and by regulating the length of the tie loop and adjusting a support, the load from articles to be carried will be transferred to the shoulder and neck portions during lifting.

10 Claims, 5 Drawing Sheets

LIFTING AND CARRYING DEVICE

FIELD OF THE INVENTION

The present invention relates to a lifting and carrying device adapted for support on a user's body and constituting an auxiliary means for the user to lift and carry articles of various size, shape and weight.

FIELDS OF APPLICATION

The present lifting and carrying device can be used in connection with a plurality of working tasks involving lifting and carrying of articles of various sizes, shape and weight. Further, said device could be used by so to say all groups of people having a need for an auxiliary device in connection with lifting and carrying operations.

The future boom of elderly people means that the welfare services for old people should be concentrated on letting the old people stay at home as long as possible. For this group of people the present lifting and carrying device may be and appropriate ancillary means for solving parts of their daily life activities.

Further, the present lifting and carrying device may be used by people suffering from certain ailments. Because the lifting and carrying of articles in general may be undertaken without the use of arms and hands if the present lifting and carrying device is utilized, people suffering for example from neurological or rheumatic ailments could extend their functional activities to a large degree.

The lifting and carrying device could also be used by the nursing staff in institutions. Many man-labour years are lost due to load damages from which the nursing staff is suffering, especially in connection with the lifting of patients. Known auxiliary means are often space and time requiring, and in view of the large working pressure under which the nursing staff is generally working, the staff will very often lift the patients without using such auxiliary means.

The owners of houses and cottages might also take advantage of the present lifting and carrying device. In connection with gardening, maintenance of the house or the cottage, transportation of various articles to and from such houses or cabins, there will always be a need for a lifting and carrying device for facilitating such operations, and for ensuring no overloading of back muscles, etc.

Also within the building crafts there is a field of application for the present lifting and carrying device. In spite of a high degree of automation much of the lifting and carrying work is performed manually on a building site, for example in connection with the moving, lifting and transportation of materials.

PRIOR ART

U.S. Pat. specification No. 4 327 852 to Gibson relates to a lightweight, flexible backpacking harness including a pair of elongated shoulder straps which are crossed and permanently joined intermediate their ends, an arrangement which lacks the possibility of transferring the weight of the article to be carried to a selectable portion of the user's back or waist portion.

U.S. Pat. No. specification 1 340 076 to Orr relates to a weight supporting means or yoke or shoulder weight carrier adapted to fit against the shoulders in such a manner that the weights connected therewith will be supported evenly over the entire shoulders, the arrangement being such that weights might be positioned so as to be supported by either shoulder or both shoulders simultaneously. Neither does this known yoke or shoulder weight carrier give any instructions for transferring the load of the article to be lifted to any portion of the user's back or waist portion.

U.S. Pat. specification 4 280 645 to Goodden relates to a harness for lifting heavy and bulky objects, including a yoke type shoulder harness spanning the distance between the shoulders of the person wearing it and also circumscribing the neck area of the user. Such a yoke type shoulder harness which has to be threaded down over the head of the user, will find application only in certain fields of application, and does not allow for a weight distribution of the load to be carried to a selectable portion of the user's back or waist portion. When using this known harness for lifting heavy objects during a lifting operation, the lower part of the spine will be the turning point of a lever extending from said lower spine portion and to the shoulders of the user, which involves that a tremendous force must be applied to the muscles in the waist or lower spine area of the user, and consequently a high risk of damaging the muscles therearound.

U.S. Pat. specification 2 718 988 to Potts relates to a duel-shoulder looped-strap carrying means, including an inter-connecting neck-encircling loop-strap member as well as two looped-strap members depending therefrom. This known carrying means suffers from the same disadvantages as the above shoulder harness of Goodden, since no supporting element extending between the lifting ties is provided.

OBJECTS OF THE PRESENT INVENTION

An object of the present invention is to provide a lifting and carrying device which is flexible and adaptable as regards size, shape and weight of the article or articles to be handled.

Further, an object of the present invention is to provide a lifting and carrying device which is flexible and easily adaptable in relation to various body shapes and sizes of the persons who are to use said device.

An object of the invention is also to provide a light weight and simple auxiliary harness which can easily be taken on and off, and which after use can be rolled up or folded together in a minimum of space.

Still another object of the invention is to provide a lifting and carrying device which is flexible and adaptable as regards the positions or locations to be taken by the device when undertaking various types of work.

Still another object of the invention is to provide a lifting and carrying device including various auxiliary equipment which can be adapted to the persons carrying said device and using this for lifting and transporting articles or goods having different size, shape and weight.

Further, an object of the invention is to provide a lifting and carrying device which can be used in connection with the lifting and the transport of especially heavy and unmanageable articles, wherein not only one but several persons having an individual lifting and carrying device can carry out the operation together.

Still another object of the invention is to provide a lifting and carrying device which during the lifting and carrying of heavy or unmanageable objects will reduce the load on hands, arms and back, which otherwise would increase the risk of load damages. This is especially important for users suffering from muscle ailments, rheumatic ailments, etc., said diseases rendering difficult even the handling of lightweight and otherwise easily manageable objects.

Another object of the present invention is to allow the user to actively use his knees and a straight back whilst lifting, a fact which aids in utilizing muscles which normally is rearly apt to be subjected to overload.

Finally, an object of the present invention is to provide a lifting and carrying device wherein a lesser or larger portion of the weight to be lifted, can be transferred to a selectable portion of the user's back and waist portion, i.e. a regulation which can be adapted to the load of the article to be lifted and the relative position between said article and the user. This regulation should also come into effect as regards how high or low the attachment point of the article is in relation to the user.

In connection with a lifting and carrying device of the type stated in the preamble said objects are achieved by the features defined in the appending claims.

BRIEF DESCRIPTION OF THE DRAWINGS

The invention will in the following be further described with reference to the enclosed drawings illustrating embodiments of the lifting and carrying device according to the invention, as well as auxiliary equipment thereof and various fields of application.

DETAILED DESCRIPTION OF PREFERRED EMBODIMENTS

Figure 1:
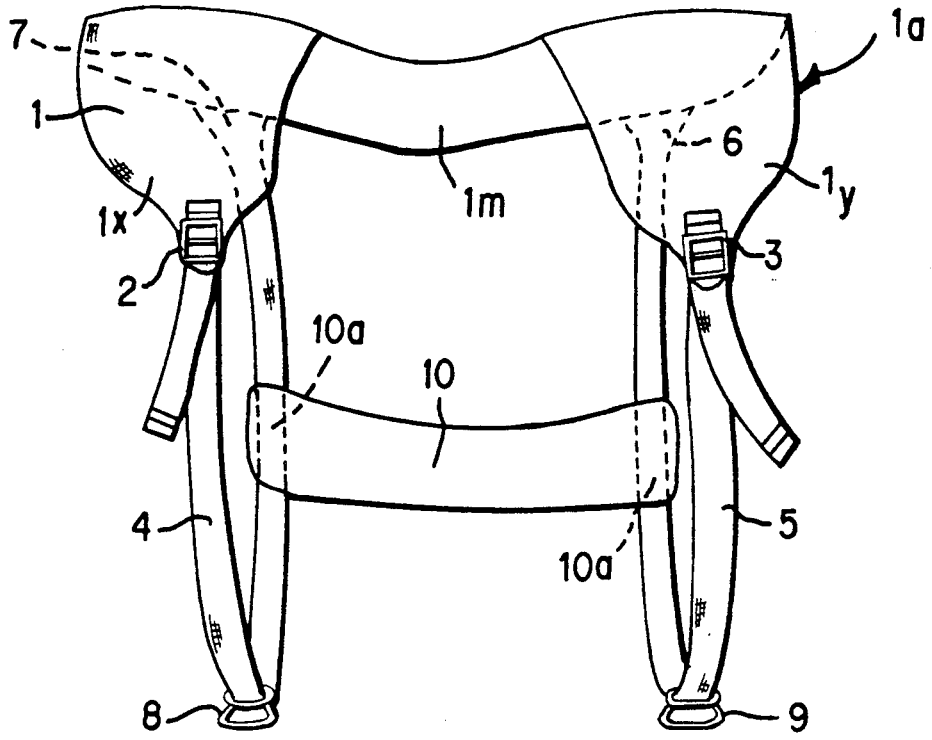
FIG. 1 is a front view of an embodiment of a lifting and carrying device according to the invention.

As appearing from FIG. 1, which is a simplified front view of a first embodiment of the lifting and carrying device according to the invention, the device which is generally designated by 1*a* comprises a relatively elongated shoulder and neck yoke 1, which preferably is made of soft and strong material. The shoulder and neck yoke 1 comprises a narrower back portion 1*m* which at the ends merges into individual end pieces 1*x* and 1*y*, respectively, each of which is equipped with a tie length regulating means 2 and 3, respectively. To each of the tie length regulating means 2 and 3 there is affixed the one end of an individual tie loop 4 and 5, respectively, which in unloaded condition depends freely from said means 2 and 3, and which at their opposite ends i.e. at the rear side of the end portions 1*x* and 1*y* are appropriately affixed thereto.

The affixing of the tie loops 4 and 5 to the shoulder and neck portion 1 can be provided by gluing, sewing and/or welding, as this is indicated by the reference numerals 6 and 7, respectively. The freely depending and adjustable tie loops 4 and 5 can be manufactured from a strong and pliable material, for example polyester fibres, which can also be the case for the shoulder and neck yoke 1.

Between the two tie loops 4 and 5 there are provided an adjustable supporting element 10, said supporting element 10 in relation to the position of use of the lifting and carrying device la being adjustable in the vertical plane. At the end portions the supporting element 10 is provided with narrow fits 10*a*, and the friction force being developed in relation to the tie loops 4 and 5 ensures that the supporting element will not change its position during lifting and carrying by means of said device 1*a*.

Figure 2A:
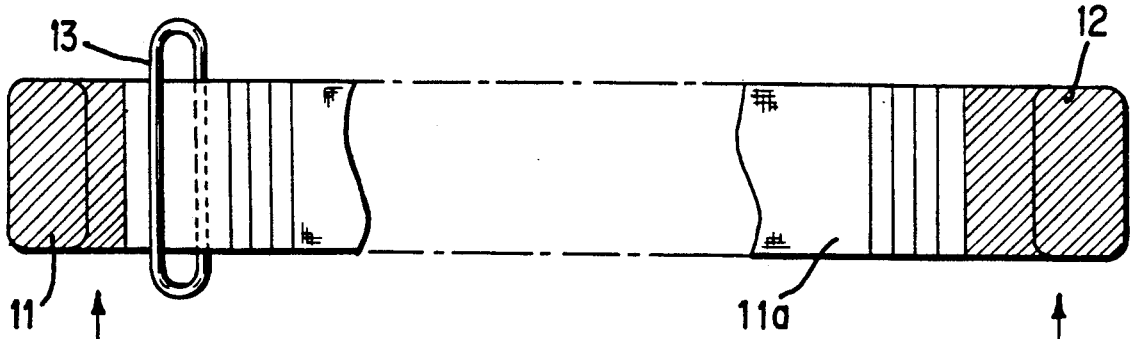
FIGS. 2*a* and 2*b* are top view and side view, respectively, of auxiliary equipment which can be used in connection with the present lifting and carrying device.
Figure 2B:
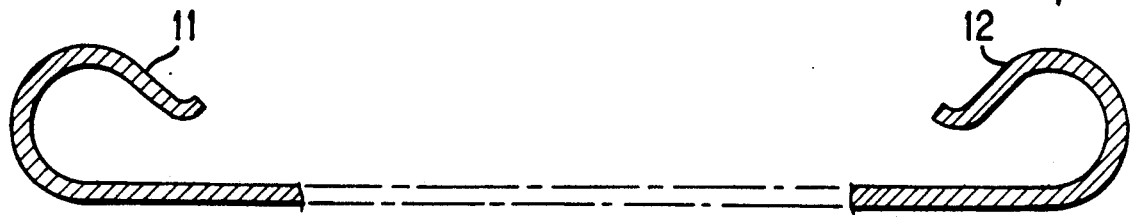

On each of the parallel tie loops 4 and 5 there are provided a hook on means 8 and 9, respectively, which can be displaced along the individual tie loop, and which can be used for the hooking on of auxiliary or additional equipment, for example of the type illustrated in FIG. 2*a* and 2*b*.

The carrying strap 11*a* which is illustrated in top view and side view on the FIG. 2*a* and 2*b*, respectively, is at each end equipped with a hoop 11 and 12, respectively, for example made of metal, and allowing attachment to the hook on means 8 and 9 on the tie loops 4 and 5.

In the vicinity of one of the hook on means 11 there might the carrying strap 11*a* be attached an oval ring 13, for example of metal, which can make it possible that the carrying strap 11*a* can be used in various manners.

After the user has taken on the lifting and carrying device 1*a* by placing the shoulder and neck yoke 1 in the shoulder and neck area of the user, and at the same time as the two parallel tie loops 4 and 5 constitute individual arcs depending between the front shoulder portions 1*x*, 1*y*, respectively, and the associated rear portion of the shoulder and neck yoke 1, then the user can attach the carrying strap 11*a* to the lifting and carrying device for performing various lifting operations. These lifting operations can for example comprise so-called one-side use of the carrying strap, said strap being attached only to the first or the second tie loop. Besides, there might be carried out a socalled double-sided lifting operation, the carrying strap than being attached to both tie loops. It is to be understood that single-sided and double-sided use of the tie loops might also be contemplated without the use of said carrying strap, as this will be discussed later.

A first single-sided use is to the fact that the carrying strap 11*a* including its one hoop 11 is hooked on the hook on means 8 only on one of the tie loops, for example the tie loop 4, whereas the other hoop 12 on the carrying strap 11*a* is hooked on the previously mentioned ring 13, for thereby defining a loop.

A second single-sided use is to the fact that the hoop 12 on the carrying strap 11*a* is threaded through said ring 13, whereafter the hoop 12 is attached to the hook on means 8 or 9 on the first or the second tie loop 4 or 5, whereafter the lifting operation will result in a tightening effect around the article to be lifted.

In order to achieve so-called double-sided lifting operation, i.e. wherein the two tie loops 4 and 5 are connected by means of the carrying strap 11*a*, and coming into effect on each side of the user, the two hoops 11 and 12 can be hooked onto the associated hook on means 8 or 9 on their individual tie loop 4 and 5, respectively.

Figure 3A:
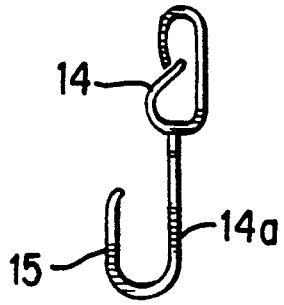
FIGS. 3*a* and 3*b* illustrate side view and frontview, respectively, of a carrying hook which can be used in the present device.
Figure 3B:
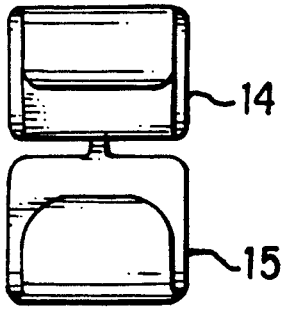
Figure 10:
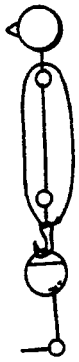

In FIG. 3*a* and 3*b* there are illustrated a side view and a front view, respectively, of a carrying hook 14*a* which is made up of a hoop 14 which can be attached to one of the hook on means 8 or 9 on the respective tie loop 4 and 5, as well as a hook portion 15 for the hooking on of for example shopping net, carrying bag, suitcases, trunks, etc., as this will be further illustrated in FIG. 10.

Figure 4:
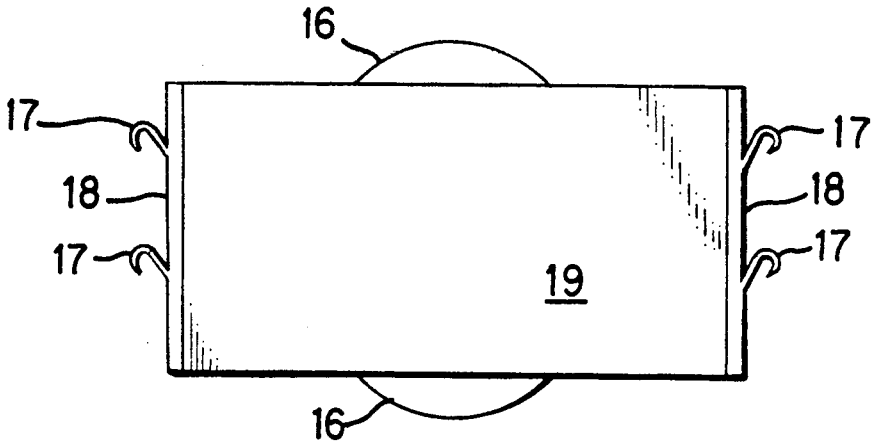
FIG. 4 illustrates diagrammatically a lifting means for patients.

In FIG. 4 there is illustrated a lifting means for the transportation of persons, for example certain types of patients, said means comprising a sitting piece 19 being provided between two ribs 18. To the ribs 18 there are attached four hoops 17 and on each of the longitudinally extending edges of the sitting piece 19 there are provided a handle 16 for facilitating the handling of said means. Otherwise, reference is means to FIG. 9, in which the use of such a sitting piece 19 is further disclosed, it being understood that the present lifting and carrying device being used in connection with such sitting piece, for thereby allowing the users to have their arms free for supporting the patient.

Figure 5A:
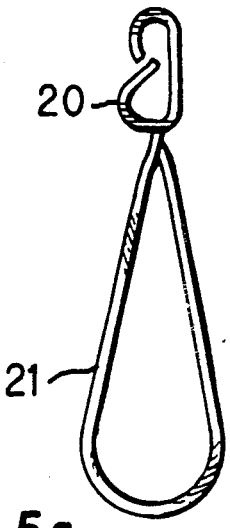
FIGS. 5*a* and 5*b* illustrate a carrying strap which can be used as extra equipment in the present device, depicted in a first and second position of use, respectively.
Figure 5B:
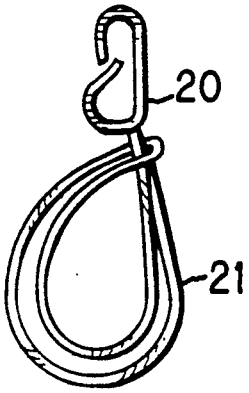

In FIG. 5*a* and 5*b* there is illustrated a variant of an auxiliary equipment, which comprises a carrying strap 21 made of a strong material, and which is attached to a hoop 20 in the shape of a loop. This equipment might represent an alternative to the carrying hook which is discussed in connection with the FIG. 3*a* and 3*b*.

Figure 6A:
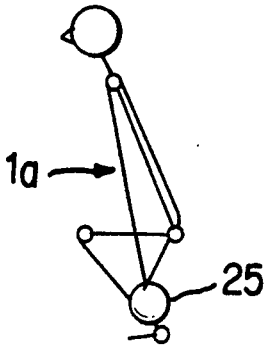
FIGS. 6*a* and 6*b* illustrate the start and the finish, respectively, of a correctly performed lift.
Figure 6B:
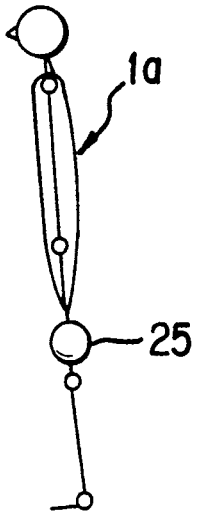

In FIG. 6*a* and 6*b* there is disclosed how a user from a position with bent knees, as illustrated in FIG. 6*a*, can perform a correct lift of an article 25, to a position illustrated in FIG. 6*b*, and then by means of the lifting and carrying device 1*a* according to the present invention.

As appearing from the simple sketches of FIG. 6*a* and 6*b*, it can be seen that the lifting and rising of the article 25 can take place without any load on hands and arms. This involves that unfavourable strain on the spine can be reduced to a minimum. During the lift itself the loading will gradually be transferred to the shoulder and neck portion, as well as to the raised spine, and then in such a manner that the danger of excess strain is reduced to a minimum.

By means of the above disclosed auxiliary equipment any user can lift not only articles of the type designated by 25 in FIG. 6*a* and 6*b*, but so to say all kinds of articles having different size, shape and weight, the lifting and the carrying being implemented in a more comfortable and safe manner then by using arms and hands and a curved back alone.

Figure 7A:
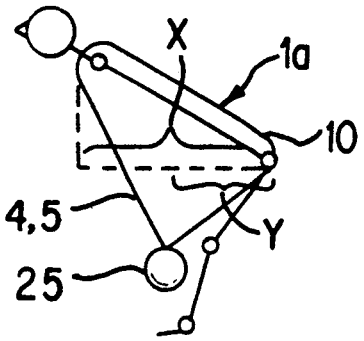
FIGS. 7*a*, 7*b* and 7*c* illustrate three different stages in a lift rendering large stress on the lower back of the user.
Figure 7B:
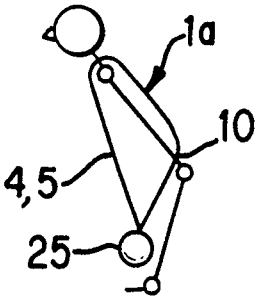
Figure 7C:
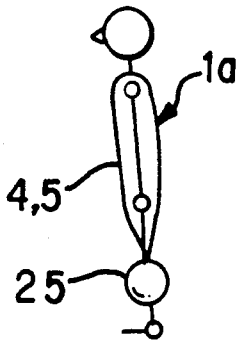

In FIG. 7*a*, 7*b* and 7*c* there is diagrammatically illustrated a "wrong" lift which is often carried out, since the user here, even by using the present lifting and carrying device 1*a*, lifts an article 25 with straight knees and a bend in his hip portion. However, even in this case of a "wrong" lift the strain on the back will be only one half, because the adjustable supporting element 10 has been located in the region of the user's hip. Due to the lifting and carrying device 1*a* the user will even by this unfavourable lifting position, achieve a halving of the lever x which would be in operation if the lift should be formed by the users arms alone. By means of the lifting and carrying device 1*a* the lever will be reduced approximately to one half, that is to the length y, as this is illustrated diagrammatically in FIG. 7*a*.

Figure 8A:
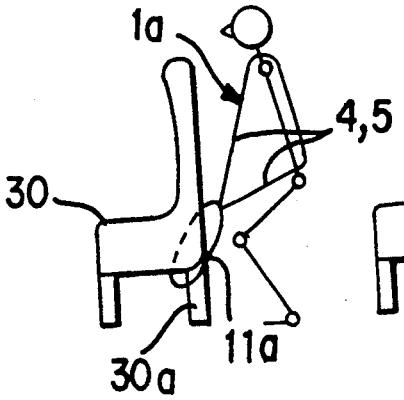
FIGS. 8*a* and 8*b* illustrate a user's application of the present lifting and carrying device.
Figure 8B:
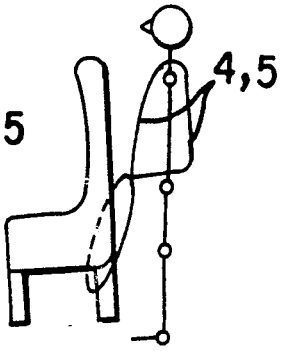

In FIG. 8 there is illustrated a further example of the use of the present lifting and carrying device 1*a*, the user here being involved in the lifting of a chair 30. After the user has taken on the lifting and carrying device 1*a*, he or she will thread a carrying strap 11*a* below the chair legs 30*a* and thereafter snap the carrying strap 11*a* onto the tie loops 4, 5. Thereafter the user can bend his knees and shorten the tie loops 4 and 5 by means of the tie length adjustable means 2 and 3. Thereafter, the user can stretch his own legs and the chair will then be lifted. The user can utilize his arms for keeping the chair close to his body and in this manner transfer the load to his shoulder and neck portion in raised position.

Figure 9:
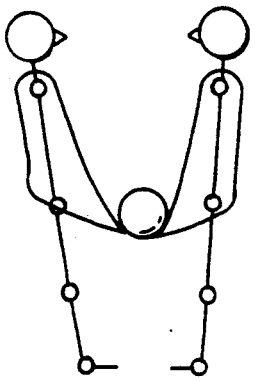
FIGS. 9 to 13 illustrate various fields of application of the present lifting and carrying device.

In FIG. 9 to 13 there are illustrated further fields of application for the present lifting and carrying device. FIG. 9 illustrates how two users can co-operate in a common lift, for example by using the lifting means for patients as discussed in connection with FIG. 4.

In FIG. 10 it is illustrated how the lifting and carrying device can be used for lifting and carrying articles provided with a handle, it here being used carrying hooks of the type discussed in connection with FIG. 3.

Figure 11:
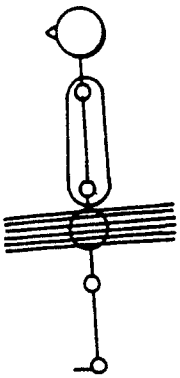

FIG. 11 depicts how a plurality of elongated elements can be handled by means of a lifting and carrying device to which is attached a tightening loop.

Figure 12:
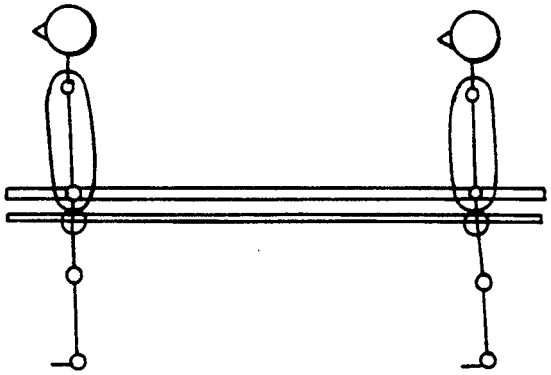

FIG. 12 depicts how two users can transport elongated articles by means of individual lifting and carrying devices according to the present invention.

Figure 13:
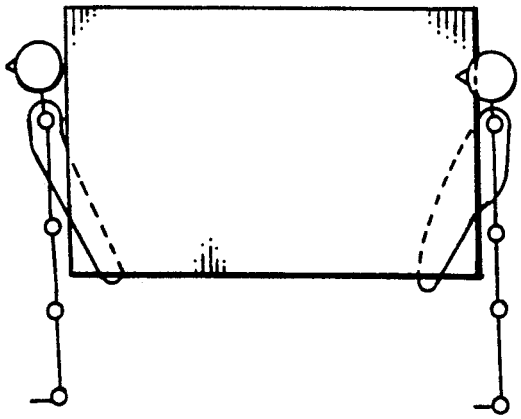

FIG. 13 illustrate two users handling a larger article therebetween, the front user utilizing his lifting and carrying device for a rear lift, whereas the rear user utilizes his lifting and carrying device for a front lift.

Figure 14:
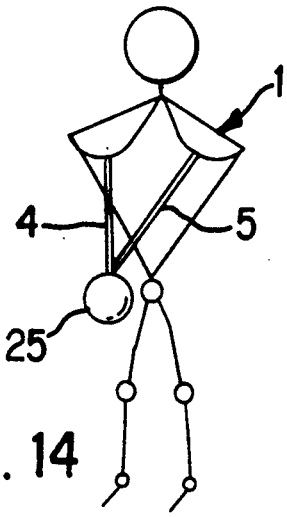
FIG. 14 illustrate a user as seen from the front, who by means of a lifting and carrying device according to the invention performs some form of side lift.

As appearing from FIG. 14 there might by utilizing the lifting and carrying device la in accordance with the present invention also be performed a so-called side-lift, wherein the two tie loops 4, 5 are used at the same time for lifting and carrying an article 25. One of the tie loops 4 is here arranged so to say vertically, whereas the second tie loop 5 is arranged in a slanting or approximately "diagonal" position. By individual adjustment of the tie loops the user can achieve approximately even loading on the right and the left side of his body, even if the lift is performed whilst the article 25 is next to the user.

Figure 15A:
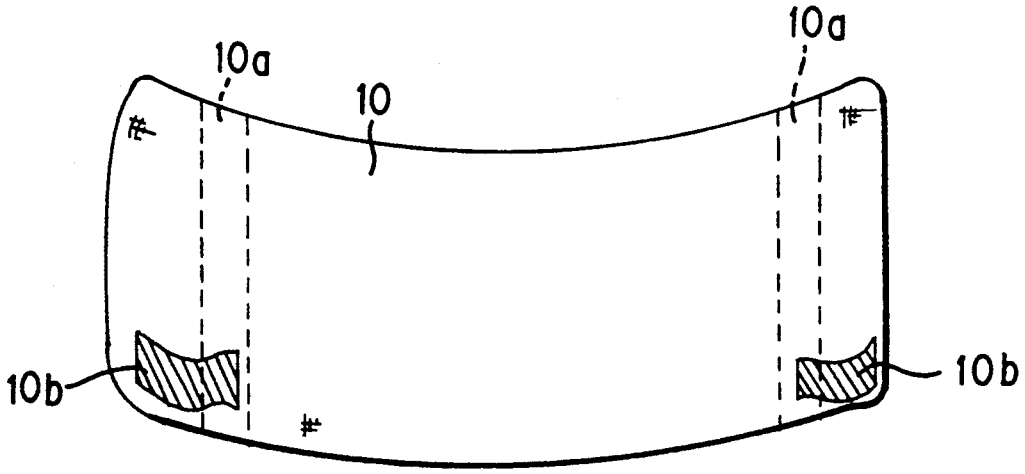
FIGS. 15*a* and 15*b* are a front view as seen from behind and a view as seen from below, respectively, of a variant of a supporting element equipped with special hoops.
Figure 15B:
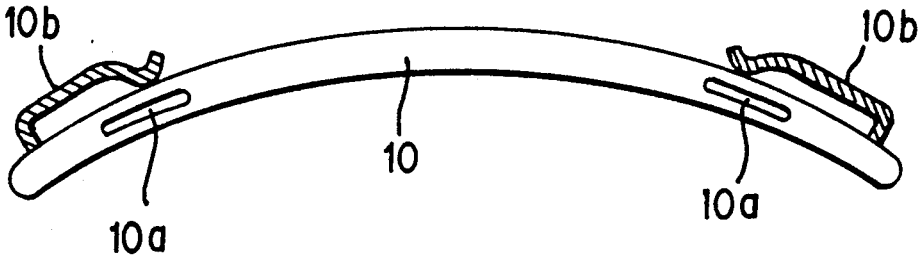

In FIG. 15*a* and 15*b* there is illustrated a variant of the embodiment of a supporting element 10 which is included in the present lifting and carrying device. Here, the supporting element 10 is at its rear surface and approximately at its lower right and lower left corner portion provided with a hoop 10*b*. The hoop 10*b* can be used in case the user wants to lift an article and the weight thereof shall influence the user as far down the user's back as possible, for example at the bottom of the hip portion. Such a manner of lifting can be especially favourable in case a heavy article is to be lifted, or if the user has a weak or bad back.

Figure 16A:
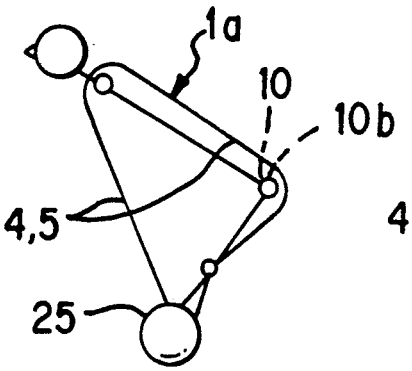
FIGS. 16*a*, 16*b* and 16*c* illustrate various positions which a user can take during a lifting operation by using the supporting element illustrated in FIGS. 15*a* and 15*b*.
Figure 16B:
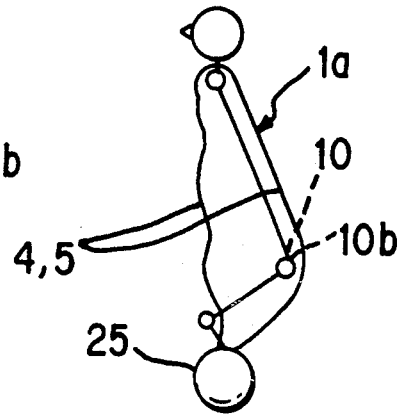
Figure 16C:
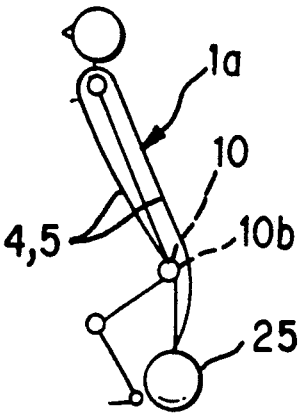

In FIG. 16*a*, 16*b* and 16*c* there is illustrated how a lift can be performed, at the same time as the lever existing between the lower back portion (hip portion) of the user and the point of gravity of the article will be reduced to a minimum.

Firstly, the user will then, see FIG. 16*a*, tighten the tie loops 4, 5 with his knees relatively straight, whilst the article 25 rests on a support.

In FIG. 16*b* the user has bent his knees somewhat more, which involves that the tie loops 4 and 5 are somewhat slackened. The user can thereby pass the front portions of each tie loop 4, 5 rearwardly and hook the latters into a respective hoop 10*b* on the supporting element 10, see FIG. 16*c*. Thereafter, the user might adjust the position of his body in relation to the article 25 to be lifted or carried, and possibly tighten the individual tie loops 4 and 5. Depending on the degree of tightening of the tie loops 4 and 5 and the position of the users body, he or she might perform a lift of the article 25 with a weight distribution which is substantially concentrated in the hip region, and which in that connection will render a minimum lever when the user during the lift operation straightens his back and rises the upper part of the body together with the article 25. In other words, there is performed a lift within the body-building terminology might be compared with a "deadlift", but wherein the present lifting and carrying device provides an even better initial lifting position, and not at last a minimum stress on the lower back. Compared with the lift performed in accordance with FIG. 7*a*-7*c*, it will be seen that by the lifting technique allowed by the lifting and carrying device 1*a* according to FIG. 15*a*, 15*b* and 16*a* to 16*c*, the previously discussed lever y (FIG. 7*a*) is reduced to an even larger degree, i.e. so to say eliminated. It is to be understood that the "interconnection" of the various regions of the tie loops 4, 5 can also be provided in other manners than those discussed in connection with FIG. 15*a*, 15*b* and FIG. 16*a*–16*c*. On the tie loops themselves there might be provided a sleeve displaceable along said tie loops, and which possibly could be equipped with a hoop or similar, into which an "opposite" region of the tie loop can be hooked. Such a sleeve could give an "interconnection" of the tie loops also in the area below or above the supporting element, and could possibly be used in addition to the above discussed hoops on the supporting element.

Possibly, a variant of the present lifting and carrying device might comprise tie loops which are not permanently affixed to the shoulder and neck yoke, but which are displaceably provided in for example slits or hoops provided on the shoulder portions 1*x*, 1*y*. It would then be possible to achieve further possibilities of adjustment for each tie loop, said tie loops then possibly being displaceable in relation to said shoulder and neck yoke.

It is to be understood that the fields of application for the present lifting and carrying device is manifold, because most of objects and articles which can be carried, would be lifted and transported by means of appropriate auxiliary equipment. The lifting and carrying device functions at its best when the weight of the articles is evenly distributed on the right and the left side of the user, but practical experiments have indicated that single-sided lifting represents no problem at all.

In other words, the present invention provides a lifting and carrying device comprising simple and lightweight parts, comprising a shoulder and neck yoke which at its front on the right and the left side thereof has attached to it individual tie length regulating means. From said regulating means there depend- two parallel tie loops, each of which forming an art which ends up at the rear side of the yoke for being appropriately attached thereto. On both tie loops there might be provided hook on means which can be freely displaced therealong. To these hook on means there might be attached auxiliary equipment which is adapted to the various carrying operations. At the rear of the back, preferably threaded onto both tie loops, there is provided a transversely extending supporting element which might be stationary for various sizes of the device, but which is preferably arranged displaceably thereto. In the latter case the friction force against the tie lops will ensure that the supporting element will remain stationary during the lifting movement and during the carrying operation.

By a mutual adaptation between the tie loops and the supporting element at the back of the user, the present lifting and carrying device might be adjusted not only to the individual user, but also to the weight, the shape and the size of the article too be lifted or carried. By tightening or slackening the tie loops the user might choose how far he should bend his knees in order to perform a lift, and by means of the adjustable supporting element the user can determine how far up or how far down on the back the weight of the article to be carried should be transferred during the lifting operation. At the same time the lifting and carrying device can in a simple manner be adapted to various auxiliary equipment, which renders the field of application for said device very much more versatile.

It is to be understood that the lifting and carrying device according to the invention can be manufactured in such manner as to be adapted to various body sizes of the user, especially as regards the width of the shoulders. In this connection the shoulder and neck yoke might for example be made adjustable as regards the "shoulder width" in question, which can also be the case of said substantially stationary or adjustable supporting elements.

We claim:

1. Lifting and carrying device (1*a*) adapted for support on a user's body, said device constituting an auxiliary means for the user to lift and carry articles of various size, shape and weight, said device (1*a*) comprising in combination:

an elongated and relatively soft shoulder and neck yoke (1) having end portions, a tie loop (4, 5) depending from the area of each end portion (1*x*, 1*y*)) of said yoke (1) and, a supporting element (10) adjustably attached to said tie means (4, 5), and extending between said tie loops (4, 5) , and selectively movable from a back portion of the user's body to the hip area of the user's body.

2. Device as claimed in claim 1, characterized in that said elongated yoke (1) comprises elongated front end portions (1*x*, 1*y*) to which are attached tie loop length regulating means (2, 3).

3. Device as claimed in claim 1, characterized in that on each tie loop (4, 5) there is provided a hook on means (8, 9) which can be displaced individually along said tie loop (4, 5).

4. Device as claimed in claim 1, characterized in that said supporting element (10) extending between said tie loops (4, 5) is attached thereto by means of narrow fits (10*a*) keeping said supporting element (10) in position by friction against said tie loops (4, 5) during use of said device.

5. Device as claimed in claim 1, characterized in that said supporting element (10) is equipped with one or more hoops (10*b*) allowing for the passage therethrough of a front portion of one or both tie loops (4, 5).

6. Device as claimed in claim 1, characterized in that each tie loop is adjustably attached to said yoke.

7. Device as claimed in claim 1, characterized in that said yoke comprises means for regulating the size thereof.

8. Device as claimed in claim 1, characterized in that said supporting element comprises means for regulating the size thereof.

9. Device as claimed in claim 3, characterized in that said device further comprises ancillary means, comprising carrying straps (11*a*) with hooks (11) adapted to co-operate with said hook on means (8, 9).

10. Device as claimed in claim 9, characterized in that said ancillary means further comprise ring-shaped means 13.

* * * * *